US006283783B1

(12) United States Patent
Shymko

(10) Patent No.: US 6,283,783 B1
(45) Date of Patent: Sep. 4, 2001

(54) FEMALE RECEPTACLE WITH RETAINING DEVICE

(76) Inventor: Wayne Shymko, 34 Dvoras Cove, Winnipeg MB (CA), R2U 4M6

( * ) Notice: Subject to any disclaimer, the term of this patent is extended or adjusted under 35 U.S.C. 154(b) by 0 days.

(21) Appl. No.: 09/422,781

(22) Filed: Oct. 21, 1999

Related U.S. Application Data

(63) Continuation-in-part of application No. 09/062,985, filed on Apr. 21, 1998, now Pat. No. 6,099,341.

(51) Int. Cl.[7] ..... H01R 13/62
(52) U.S. Cl. ..... 439/369; 439/371
(58) Field of Search ..... 439/369–372, 439/345, 451, 455

(56) References Cited

U.S. PATENT DOCUMENTS 4,664,463 * 5/1987 Carmo ..... 439/369
4,875,874 * 10/1989 Windsor, Jr. ..... 439/369
4,917,625 * 4/1990 Haile ..... 439/369
5,582,524 * 12/1996 Sanner et al. ..... 439/369
5,931,702 * 8/1999 Fladung ..... 439/369
6,099,341 * 8/2000 Shymko ..... 439/369

* cited by examiner

*Primary Examiner*—Hien Vu
(74) *Attorney, Agent, or Firm*—Donald J. Ersler

(57) ABSTRACT

A female receptacle includes a body, at least one female power connection, at least one hoop, and a power supply cord. The at least one hoop extends outward from each end of the body. A void is created between the body and the inside of the hoop. The at least one female power connection is preferably formed in a top of the body. The power supply cord supplies each female power connection with electrical power. In use, each male cord is inserted through the void and looped around to prevent the male plug from being withdrawn from the female power connection. A second embodiment has the addition of a restraint tab. One end of the restrain tab is preferably pivotally mounted to the body, the other end of the restrain tab preferably snaps into the hoop. In use, the restraint tab is placed in an open position. The male cord is inserted through the void. The restraint tab is then placed in a closed position such that the male cord is restricted from movement past the restraint tab. The male plug is then inserted into the female power connection without fear of being withdrawn therefrom. In a third embodiment, the female receptacle has the addition of at least one restraint tab.

5 Claims, 6 Drawing Sheets

FEMALE RECEPTACLE WITH RETAINING DEVICE

CROSS-REFERENCES TO RELATED APPLICATIONS

This is a continuation-in-part application of Ser. No. 09/062,985 filed on Apr. 21, 1998 now U.S. Pat. No. 6,099,341.

BACKGROUND OF THE INVENTION

1. Field of the Invention

The present invention relates generally to female power receptacles and more specifically to a female receptacle with retaining device for securing a male plug to a female power connection to prevent the male plug from being withdrawn from the female power connection.

2. Discussion of the Prior Art

A problem frequently encountered with the connection between a male plug and a female power connection is the possibility of the male plug being pulled out of the female power connection. Even if the male plug is not pulled out of the female power connection, the male plug may be damaged due to the strain placed on the cord. One solution has been to use tape to prevent the male plug from being separated from the female power connection.

Accordingly, there is a clearly felt need in the art for a female receptacle with retaining device for securing a male plug to a female power connection to prevent the male plug from being pulled out of the female power connection, for preventing a male plug from being damaged due to strain, and which does not require tape or the like to retain the male plug in the female power connection.

SUMMARY OF THE INVENTION

The primary objective of the present invention is to provide a female receptacle with retaining device for securing a male plug to a female power connection to prevent the male plug from being pulled out of the female power connection, for preventing a male plug from being damaged due to strain, and which does not require tape or the like to retain the male plug in the female power connection.

According to the present invention, a female receptacle includes a body, at least one female power connection, at least one hoop, and a power supply cord. The at least one hoop extends outward from each end of the body. A void is created between the body and the inside of the hoop. The at least one female power connection is preferably formed in a top of the body. The power supply cord supplies each female power connection with electrical power. The female receptacle is preferably fabricated from a material which will withstand the abuse and atmospheric conditions which a female receptacle would be exposed to. Some of these materials include rubber, PVC, or other suitable material. In use, each male cord is inserted through the void and looped around to prevent the male plug from being withdrawn from the female power connection. In a second embodiment, the female receptacle includes a body, a restraint tab, a female power connection, a hoop, and a power supply cord. The hoop extends outward from each end of the body. A void is created between the body and the inside of the hoop. One end of the restrain tab is preferably pivotally mounted to the body, the other end of the restrain tab preferably snaps into the hoop. The female power connection is formed at one end of the body and the power supply cord is disposed at the other end of the body. The power supply cord supplies the female power connection with electrical power. The female receptacle is preferably fabricated from a material which will withstand the abuse and atmospheric conditions which a female receptacle would be exposed to. Some of these materials include rubber, PVC, or other suitable material. In use, the restraint tab is placed in an open position. The male cord is inserted through the void. The restraint tab is then placed in a closed position such that the male cord is restricted from movement past the restraint tab. The male plug is then inserted into the female power connection without fear of being withdrawn therefrom.

In a third embodiment, the female receptacle includes a body, at least two restrain tabs, at least two female power connections, at least two hoops, and a power supply cord. One end of each restrain tab is preferably pivotally mounted to the body, the other end of each restrain tab preferably snaps into the hoop. Each hoop extends outward from each end of the body. A void is created between the body and the inside of each hoop. Each female power connection is preferably formed in a top of the body. The power supply cord supplies each female power connection with electrical power. The female receptacle is preferably fabricated from a material which will withstand the abuse and atmospheric conditions which a female receptacle would be exposed to. Some of these materials include rubber, PVC, or other suitable material. In use, each restraint tab is placed in an open position. The male cord is inserted through the void. The restraint tab is then placed in a closed position such that the male cord is restricted from movement past the restraint tab. The male plug is then inserted into the female power connection without fear of being withdrawn therefrom.

Accordingly, it is an object of the present invention to provide a female receptacle with retaining device for securing a male plug to a female power connection which prevents the male plug from being pulled out of the female power connection.

It is a further object of the present invention to provide a female receptacle with retaining device for securing a male plug to a female power connection which prevents the male plug from being damaged due to strain.

Finally, it is another object of the present invention to provide a female receptacle with retaining device for securing a male plug to a female power connection which does not require tape or the like to prevent the male plug from being pulled out of the female power connection.

These and additional objects, advantages, features and benefits of the present invention will become apparent from the following specification.

DETAILED DESCRIPTION OF THE PREFERRED EMBODIMENTS

Figure 1:
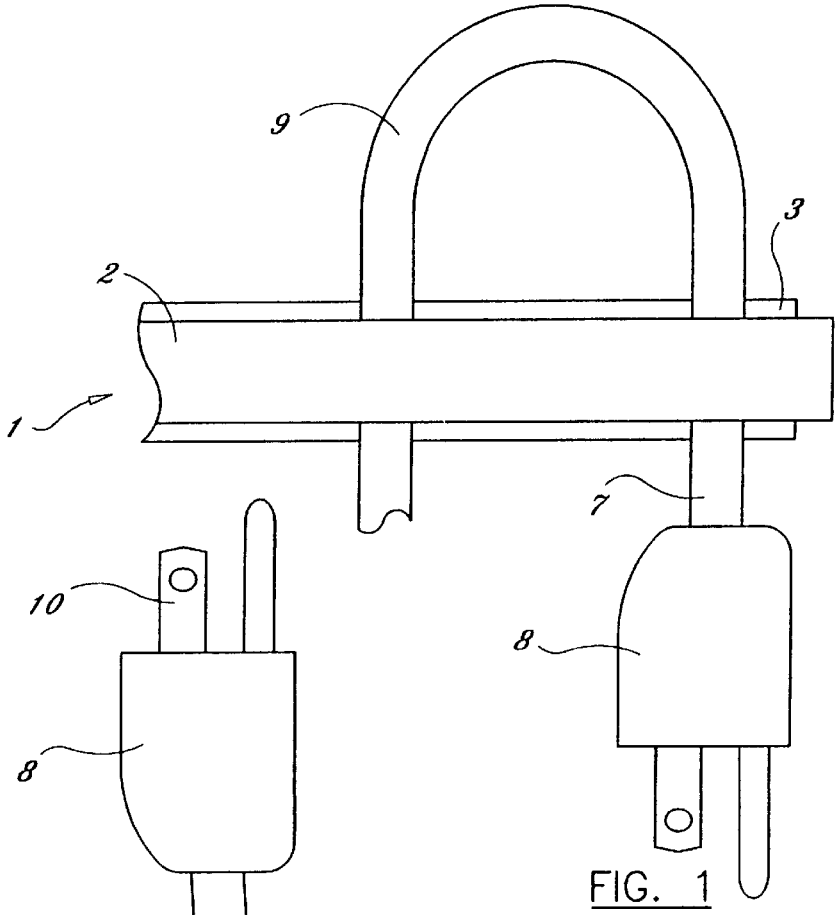
FIG. 1 is a front view of the female receptacle with a power cord inserted in step 1 of the threading operation.
Figure 5:
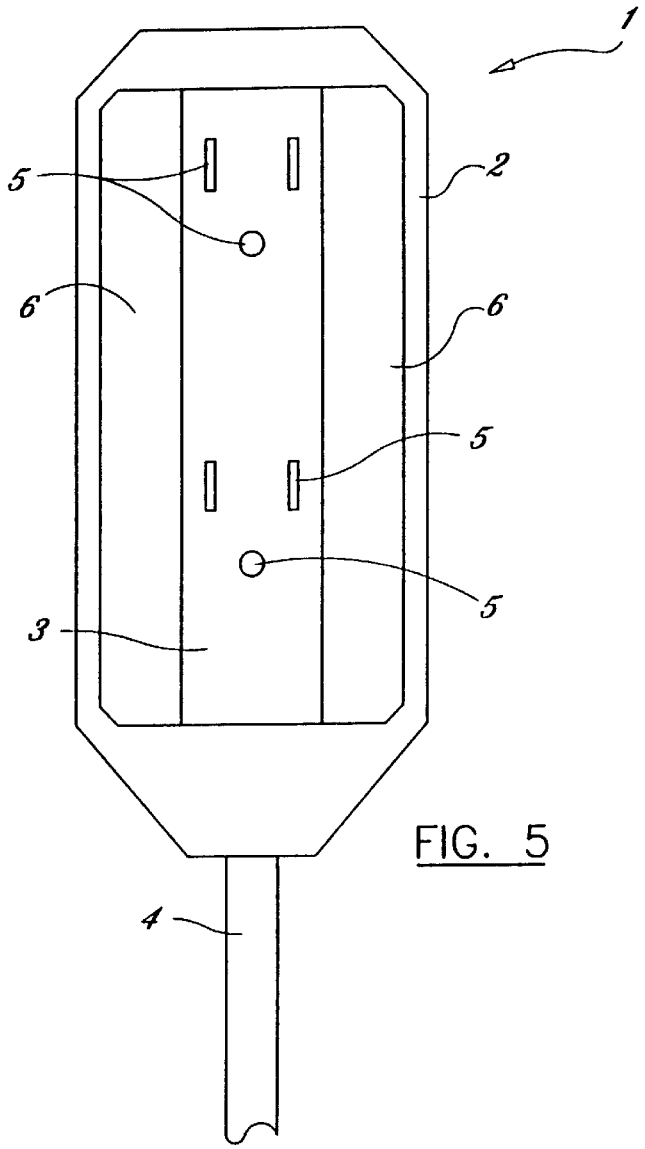
FIG. 5 is a top view of the female receptacle.
Figure 6:
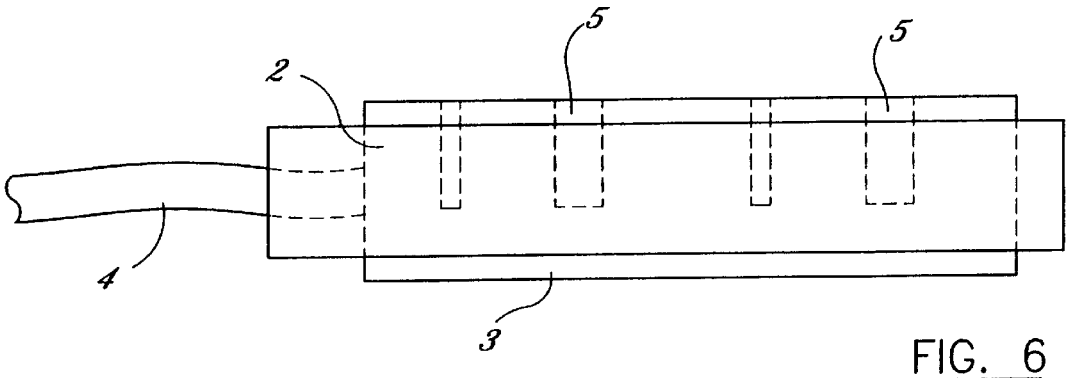
FIG. 6 is a front view of the female receptacle.

With reference now to the drawings, and particularly to FIGS. 5 and 6, there is shown a top view of a female receptacle 1. With reference to FIG. 1, the female receptacle includes a body 3, at least one female power connection 5, at least one hoop 2, and a power supply cord 4. The at least one hoop 2 extends outward from each end of the body 3. A void 6 is created between the body 3 and the inside of the hoop 2. The void 6 is wide enough to provide clearance for a power cord 7. The at least one female power connection 5 is preferably formed in a top of the body 3. The power supply cord 4 supplies each female power connection 5 with electrical power. The female receptacle 1 may be fabricated by over molding the power supply cord 4 and the at least one female power connection 5. The female receptacle 1 may also be fabricated in a multipiece modular form that may be retrofited to existing power supply cords. The female receptacle 1 is preferably fabricated from a material which will withstand the abuse and atmospheric conditions which a female receptacle would be exposed to. Some of these materials include rubber, PVC, or other suitable material.

Figure 2:
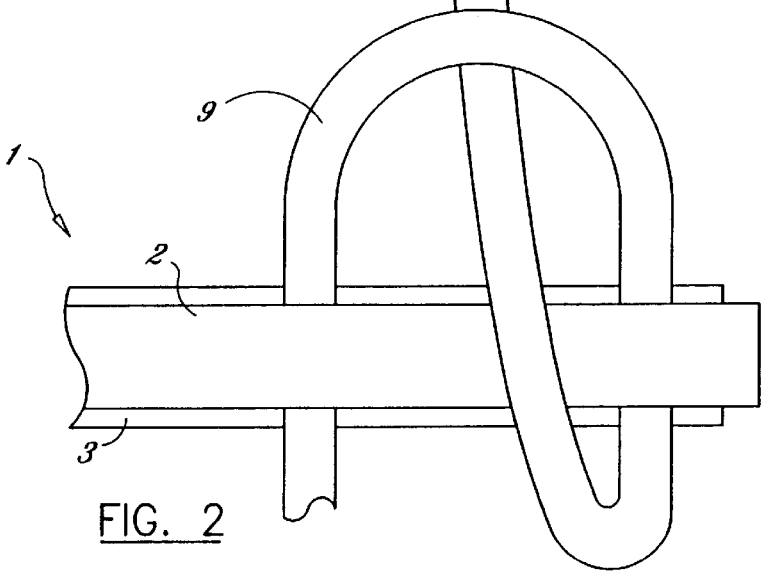
FIG. 2 is a front view of the female receptacle with a power cord inserted in step 2 of the threading operation.
Figure 3:
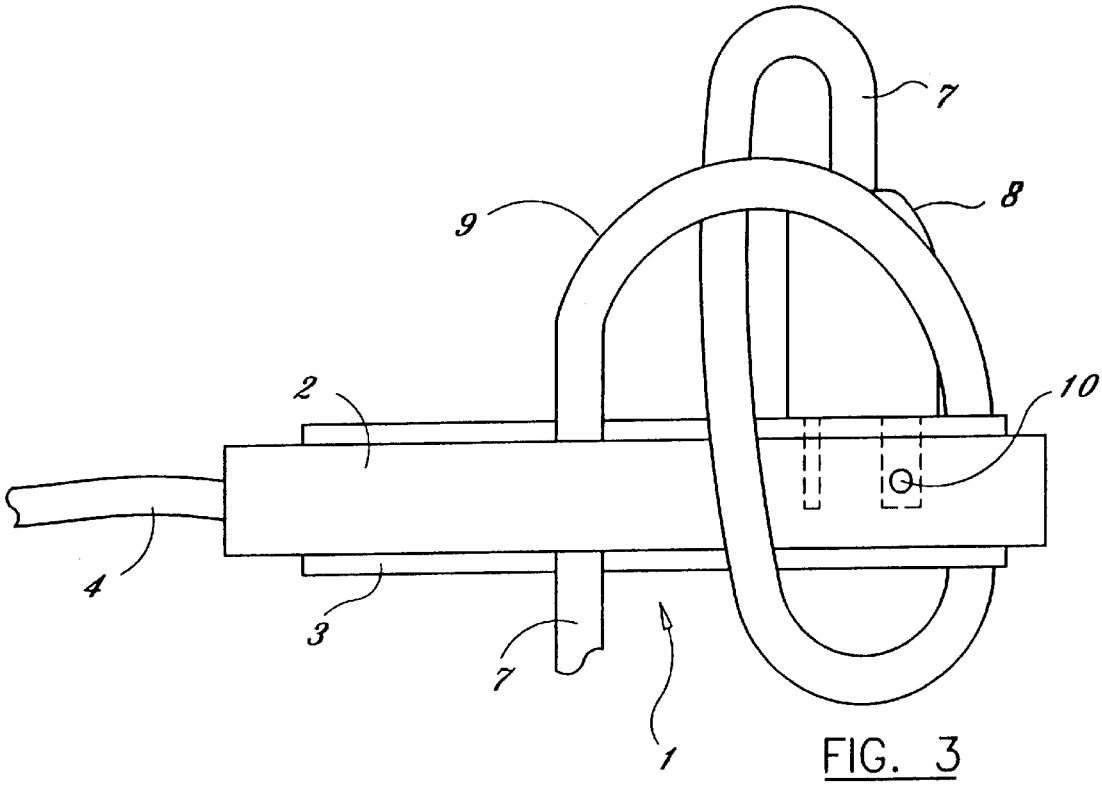
FIG. 3 is a front view of the female receptacle with a power cord inserted in a final step of the threading operation.
Figure 4:
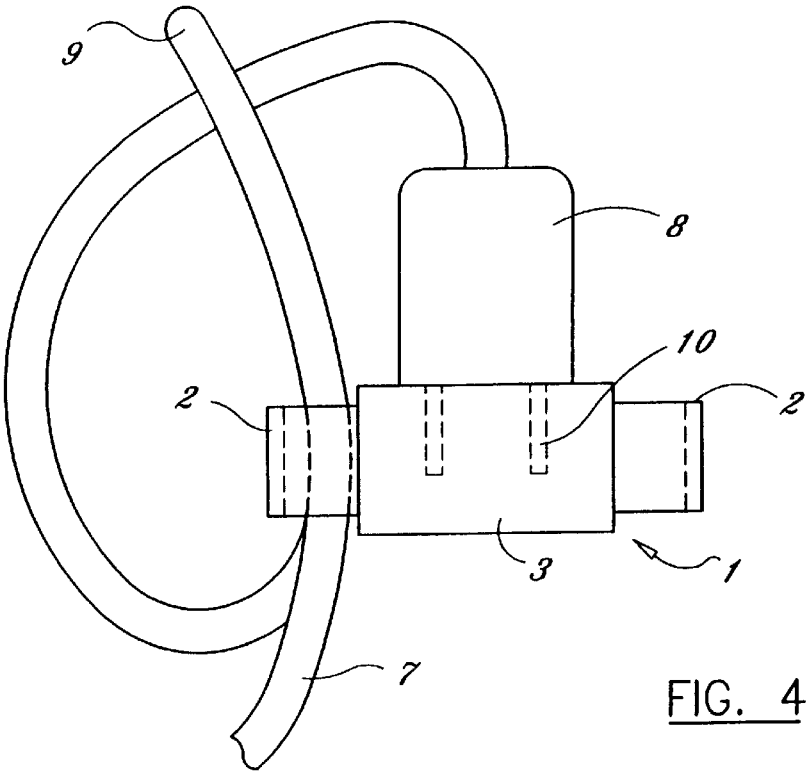
FIG. 4 is an end view of the female receptacle with a power cord inserted in a final step of the threading operation.

FIG. 1 shows the first step where the male cord 7 is bent into an "U" shaped loop 9 and inserted through the void. FIG. 2 shows the second step of inserting the male plug 8 through the "U" shaped loop 9. FIGS. 3 and 4 show the male prongs 10 inserted into the female power connection 5. The female receptacle 1 provides secure strain relief between the male plug 8 and the female power connection 5. The male plug 8 is removed from the female connection 5 by reversing the previous steps.

Figure 7:
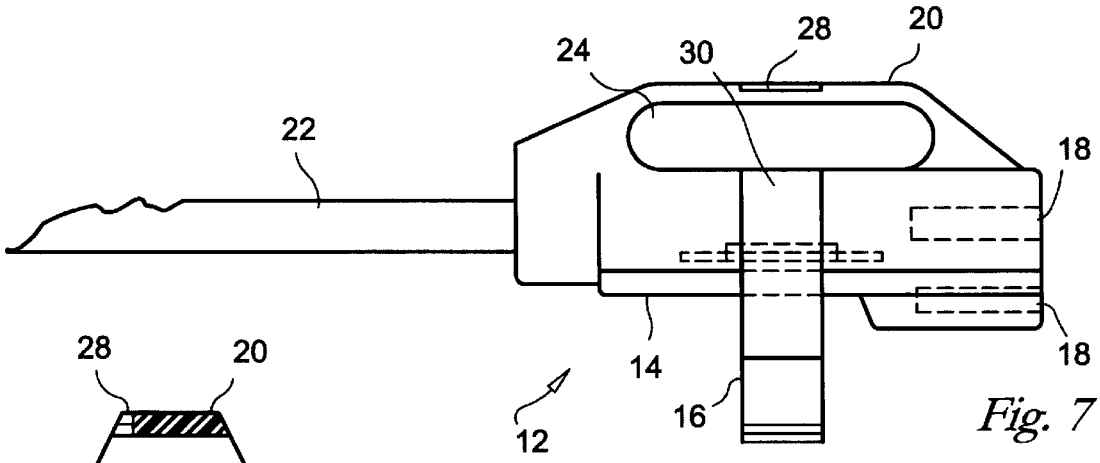
FIG. 7 is a side view of a second embodiment of the female receptacle with a restraint tab in an open position.
Figure 8:
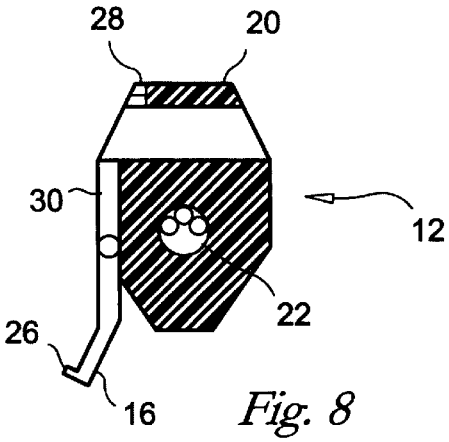
FIG. 8 is a cross-sectional view of a second embodiment of the female receptacle with a restraint tab in an open position.
Figure 10:
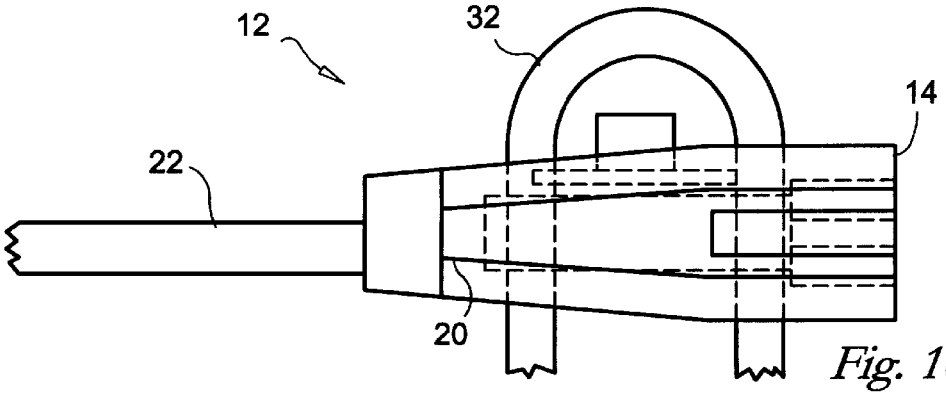
FIG. 10 is a top view of the second embodiment of the female receptacle with a power cord inserted through a void and with a restraint tab in an open position.

With reference to FIGS. 7, 8 and 10, a second embodiment of a female receptacle 12 includes a body 14, a restraint tab 16, a female power connection 18, a hoop 20, and a power supply cord 22. The hoop 20 extends outward from each end of the body 14. A void 24 is created between the body 14 and the inside of the hoop 20. The void 20 is wide enough to provide clearance for a male power cord 32. One end of the restraint tab 16 is preferably pivotally mounted to a side of the body 14. The other end of the restraint tab 16 preferably has a snap projection 26 which snaps into a snap cavity 28. The snap cavity 28 is disposed in the hoop 20. A tab cavity 30 provides clearance for the restraint tab 16 when thereof is in a closed position. The restrain tab 16 could also be pivotally connected to the hoop 20 and snapped into the body 14. Other restraint devices besides the restraint tab 16 may be used such as any device which is placed between the inside of male power cord 32 and the side of the female receptacle 12.

The female power connection 18 is preferably formed at one end of the body 14 and the power supply cord 22 extends from the other end of the body 14. The female power connection 18 may also be formed in the side of the body 14. The power supply cord 22 supplies the female power connection 18 with electrical power. The female receptacle 12 is preferably fabricated from a material which will withstand the abuse and atmospheric conditions which a female receptacle 12 would be exposed to. Some of these materials include rubber, PVC, or other suitable material.

Figure 9:
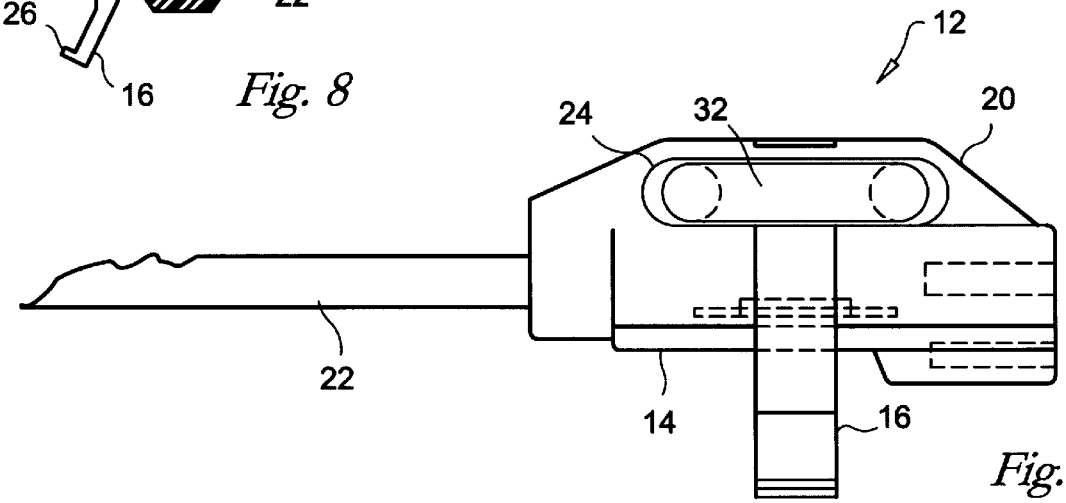
FIG. 9 is a side view of the second embodiment of the female receptacle with a power cord inserted through a void and with a restraint tab in an open position.
Figure 11:
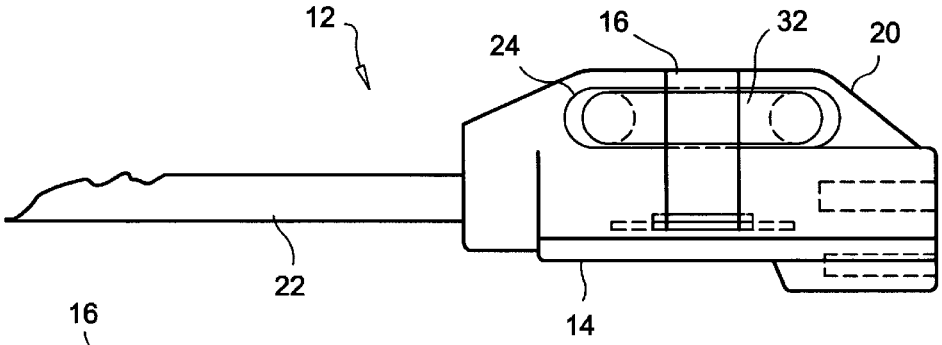
FIG. 11 is a side view of the second embodiment of the female receptacle with a power cord inserted through a void and with a restraint tab in a closed position.
Figure 12:
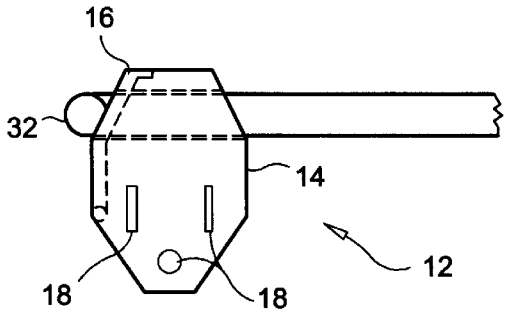
FIG. 12 is an end view of the second embodiment of the female receptacle with a power cord inserted through a void and with a restraint tab in a closed position.
Figure 13:
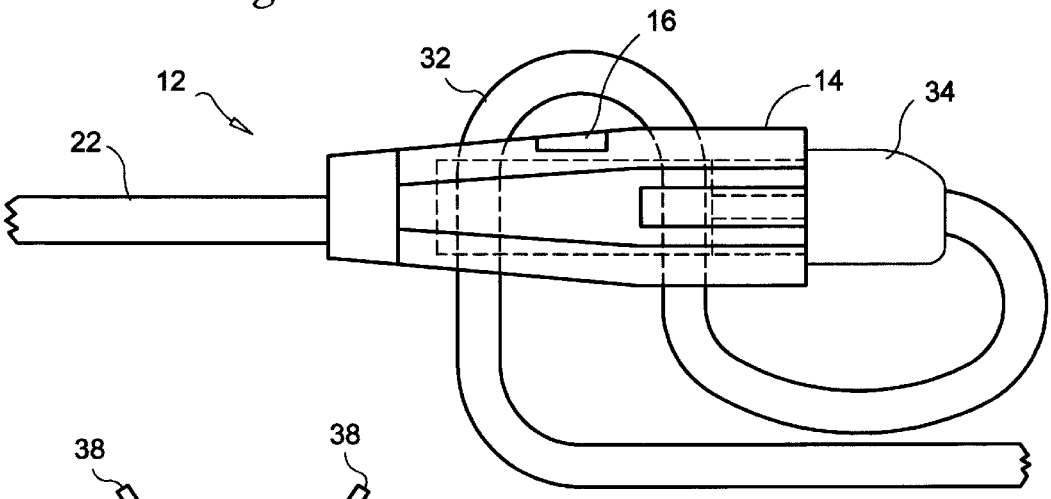
FIG. 13 is a bottom view of the second embodiment of the female receptacle with a male plug inserted into thereof and restrained from being removed from the female power connection.

FIGS. 9 and 10 show a power cord 32 formed into a "U" -shaped loop and inserted through the void 24 with the restrain tab 16 in an open position. FIGS. 11 and 12 show the restraint tab 16 in a locked position which prevents the power cord 32 from being pulled through the void 24. FIG. 13 shows the power cord 32 restrained by the restraint tab 16 and the male plug 34 inserted into the female power connection 18. The male plug 34 may not be withdrawn from the female power connection 18 by yanking the power cord 32.

Figure 15:
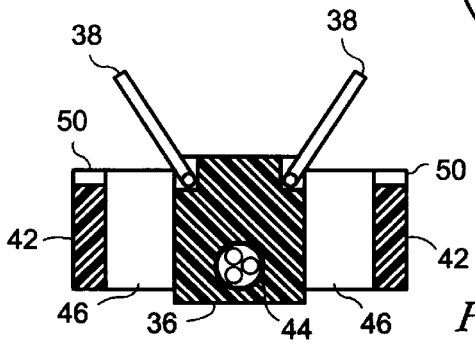
FIG. 15 is a cross-sectional view of a third embodiment of the female receptacle with restraint tabs in an open position.
Figure 14:
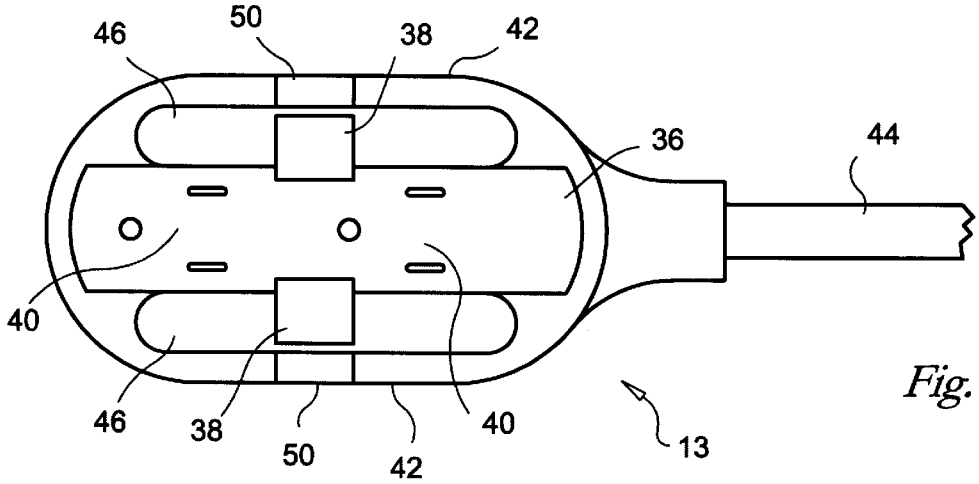
FIG. 14 is a top view of a third embodiment of the female receptacle with restraint tabs in an open position.
Figure 17:
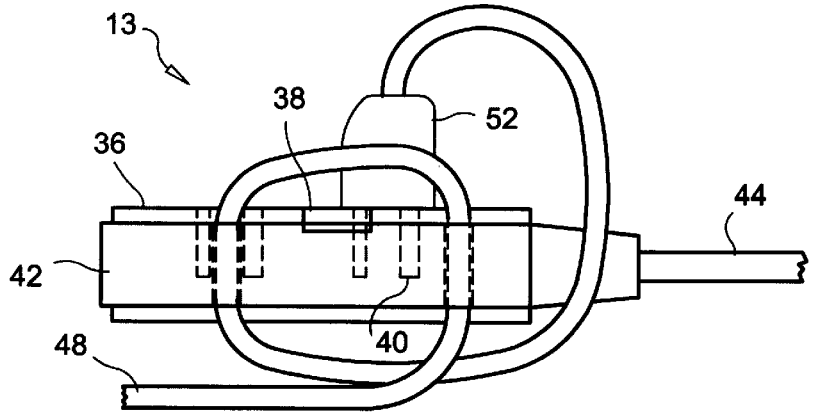
FIG. 17 is a side view of the third embodiment of the female receptacle with a power cord inserted through one of the voids and with a restraint tab in a closed position.

With reference to FIGS. 14, 15 and 17, a third embodiment of a female receptacle 13 includes a body 36, at least two restraint tabs 38, at least two female power connections 40, at least two hoops 42, and a power supply cord 44. Each hoop 42 extends outward from each end of the body 36. A void 46 is created between the body 36 and the inside of each hoop 42. The void 46 is wide enough to provide clearance for the male power cord 48. One end of each restraint tab 38 is preferably pivotally mounted to a side of the body 36. The other end of each restraint tab 38 preferably snaps into a snap cavity 50 in the hoop 42. The restrain tab 38 could also be pivotally connected to the hoop 42 and snapped into the body 36. Other restraint devices besides the restraint tab 38 may be used such as any device which is placed between the inside of male power cord 48 or 49 and the body 36. The at least two female power connections 40 are preferably formed in a top of the body 36 and the power supply cord 44 extends from an end of the body 36. The power supply cord 44 supplies the female power connection 40 with electrical power. The female receptacle 13 is preferably fabricated from a material which will withstand the abuse and atmospheric conditions which a female receptacle 13 would be exposed to. Some of these materials include rubber, PVC, or other suitable material.

Figure 16:
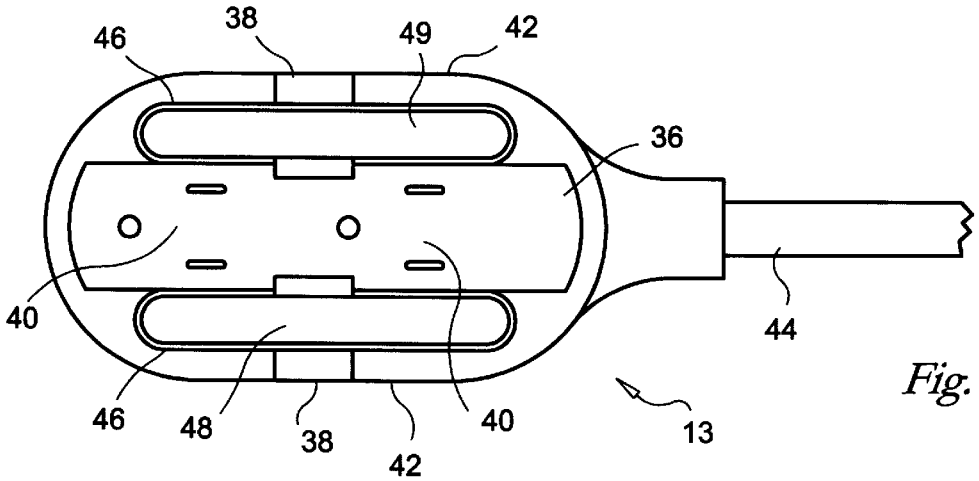
FIG. 16 is a top view of a third embodiment of the female receptacle with a power cord inserted through each void and with the restraint tabs in a closed position.

FIG. 16 shows a power cord 48 formed into a "U" -shaped loop and inserted through the void 46 with the restrain tab 38 in a closed position. The closed or locked position which prevents the power cord 48 or 49 from being removed from the void 46. A power cord 49 is inserted through a second void in the female receptacle 13. With reference to FIG. 17, the power cord 48 is restrained by the restraint tab 38 and the male plug 52 inserted into the female power connection 40. The male plug 52 may not be withdrawn from the female power connection 40 by yanking the power cord 48.

The female receptacles 1 and 13 may be manufactured in any length with any number of female power connections and restraint tabs to receive any number of male plugs. The hoops may be any length as required.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A female receptacle with retaining device for securing a male plug of a power cord to a female power connection of said female receptacle, said female receptacle, comprising:

a body having two ends, said female power connection being disposed on one end and a power cord on the other end thereof;

a hoop extending outward from said body, a void being created between an inside of said hoop and said body, said void being large enough to allow said power cord bent into a "U" shape to be inserted therein; and a restraint tab having one end being pivotally attached to one side of said body and the other end of said restraint tab having a snap projection extending therefrom, a snap cavity being formed in said hoop, said snap cavity being structured to lock with said snap projection, so that said power cord may not be withdrawn from said female receptacle.

2. A female receptacle with retaining device for securing a male plug of a power cord to a female power connection of said female receptacle, said female receptacle of claim 1 wherein:

said power supply cord being electrically connected to said female power connection.

3. A female receptacle with retaining device for securing a male plug of a power cord to a female power connection of said female receptacle, said female receptacle of claim 1 wherein:

a tab cavity being formed on said body, said tab cavity providing clearance for said restraint tab, when said restraint tab is in a closed position.

4. A female receptacle with retaining device for securing a male plug of a power cord to a female power connection of said female receptacle, said female receptacle, comprising:

a body having two ends, said female power connection being disposed on one end and a power cord on the other end thereof, said power supply cord being electrically connected to said female power connection;

a hoop extending outward from a length of said body, a void being created between an inside of said hoop and said body, said void being large enough to allow said power cord bent into a "U" shape to be inserted therein; and a restraint tab having one end being pivotally attached to one side of said body and the other end of said restraint tab having a snap projection extending therefrom, a snap cavity being formed in said hoop, said snap cavity being structured to lock with said snap projection, so that said power cord may not be withdrawn from said female receptacle.

5. A female receptacle with retaining device for securing a male plug of a power cord to a female power connection of said female receptacle, said female receptacle of claim 4 wherein:

a tab cavity being formed on said body, said tab cavity providing clearance for said restraint tab when said restraint tab is in a closed position.

* * * * *